United States Patent [19]

Grosko

[11] 4,096,040

[45] Jun. 20, 1978

[54] TRIPPER BEAM

[75] Inventor: John A. Grosko, West Mifflin, Pa.

[73] Assignee: United States Steel Corporation, Pittsburgh, Pa.

[21] Appl. No.: 781,096

[22] Filed: Mar. 25, 1977

[51] Int. Cl.[2] ..... C10B 39/08; C10B 39/14; C10B 45/00

[52] U.S. Cl. ..... 202/262; 202/227; 202/263; 202/269

[58] Field of Search ..... 202/262, 263, 253, 227, 202/269; 13/33; 214/18 R, 18 PH

[56] References Cited

U.S. PATENT DOCUMENTS

| | | | |
|---|---|---|---|
| 2,580,700 | 1/1952 | Phillips | 202/252 |
| 3,868,309 | 2/1975 | Sustarsic et al. | 202/262 |
| 3,951,751 | 4/1976 | Jakimowicz et al. | 202/253 |
| 3,970,526 | 7/1976 | Bender et al. | 202/253 |
| 3,984,289 | 10/1976 | Sustarsic et al. | 202/262 |

*Primary Examiner*—Morris O. Wolk
*Assistant Examiner*—Bradley Garris
*Attorney, Agent, or Firm*—Frank Madonia

[57] ABSTRACT

An improved tripper beam arrangement for actuating the slats of a slatted top quench car.

2 Claims, 3 Drawing Figures

TRIPPER BEAM

BACKGROUND

A pending U.S. patent application, Ser. No. 664,774, filed Mar. 8, 1976, now U.S. Pat. No. 4,039,394, and of common ownership, discloses a slatted top closure for a quench car. It had been common practice in coke making to transport incandescent coke from a coke oven to a quench tower in an open top quench car. This practice is subject to criticism because between the pushed oven and the quench tower, the combustion of coke in the car causes considerable pollution of the air. The slatted top quench car maintains the car in a covered state except when access to the car is required as when coke enters and when coke is quenched. The slatted top quench car has a plurality of normally closed slats transversing the top of the quench car. These slats are adapted to be opened to admit coke into the car and to admit quenching water into the car for quenching the coke.

Each slat is rotatably mounted along one edge to the car and has a cam follower attached at one end by a lever arm. A counterweight is mounted to the other end of the slat to maintain the slats in a normally closed position.

At the coke guide positioned in front of the coke oven, the slats are tripped open preferably by a tripper beam which comprises a cam track mounted on or near the coke guide. The tripper beam cooperates with the cam followers to open the slats immediately in front of the guide as the car moves past the oven during a coke push. The slats are tripped open to permit the coke to enter the car, then closed again just past the mouth of the oven where the cam followers disengage the tripper beam. A continuous cover is thus provided for the quench car during its travel to the quench tower. At the quench tower another tripper beam opens all the slats to permit effective quenching of the coke in the car.

Prior to the present invention, the tripper beam was rigidly mounted on or near the coke guide. The quench car could not pass the tripper beam without engaging the cam followers with the beam and thereby opening the slats. If the coke is pushed into the car as the car travels in one direction and the car must then proceed in the opposite direction to reach the quench tower, the cam followers would necessarily engage the tripper beam again and the slats would be opened. Certain drawbacks are inherent in the use of the rigidly mounted tripper beam. First, the rate of travel of the car past the tripper beam must be less than normal operating speed. This slower rate wastes valuable operating time and should be avoided. Second, if the rate of travel is too great, then damage to the tripper beam, the quench car, the coke guide, or all of them will result. Third, to unnecessarily open the slats when the car is full of incandescent coke would mean to diminish the pollution control effect of the car.

SUMMARY

According to the present invention, there is provided a retractable tripper beam for opening the slats of a slatted top quench car. In its extended position, the beam cooperates with cam followers to trip open the slats as the car moves past the beam. In the retracted position, the beam is out of the path of travel of the quench car and thus the car is able to pass the beam without tripping open the slats. The quench car can then be operated at normal speed without equipment damage. Further, the car can remain closed after receiving coke until it reaches the quench tower, regardless of its direction of travel when receiving coke.

The invention will be further described by way of example, with reference to the accompanying drawings.

DESCRIPTION OF THE PREFERRED EMBODIMENT

Referring to the figures, tripper beam 10 is shown mounted on coke guide 12. Cam followers 14 are shown (in phantom) in engagement with the bottom surface of tripper beam 10 and slats 16 (also in phantom) are shown in various positions from the normally closed (horizontal) position to the open (vertical) position.

Figure 1:
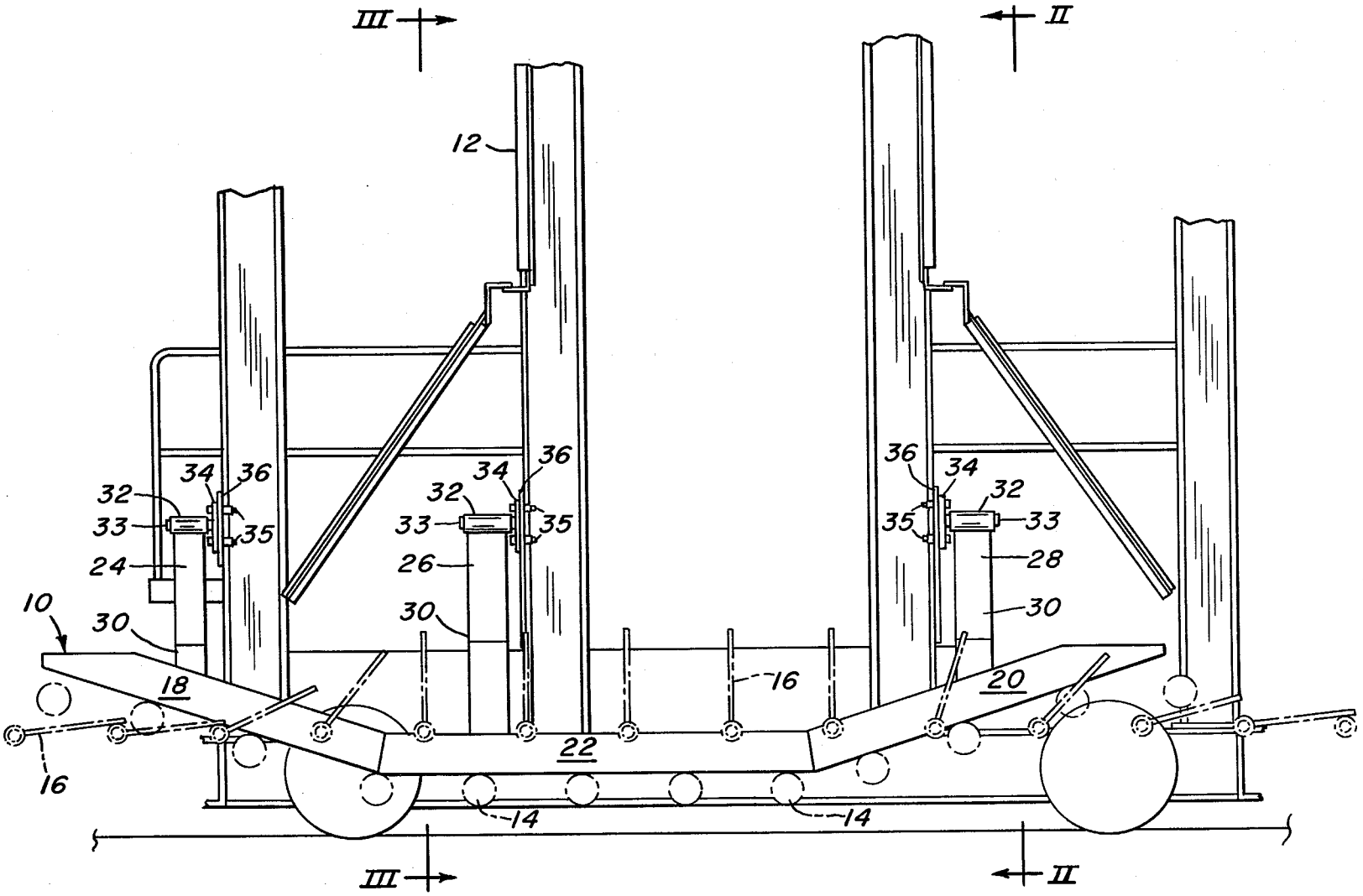
FIG. 1 is a front elevation view of a coke guide on which is mounted the tripper beam made in accordance with this invention with the cam followers and slats also depicted.
Figure 2:
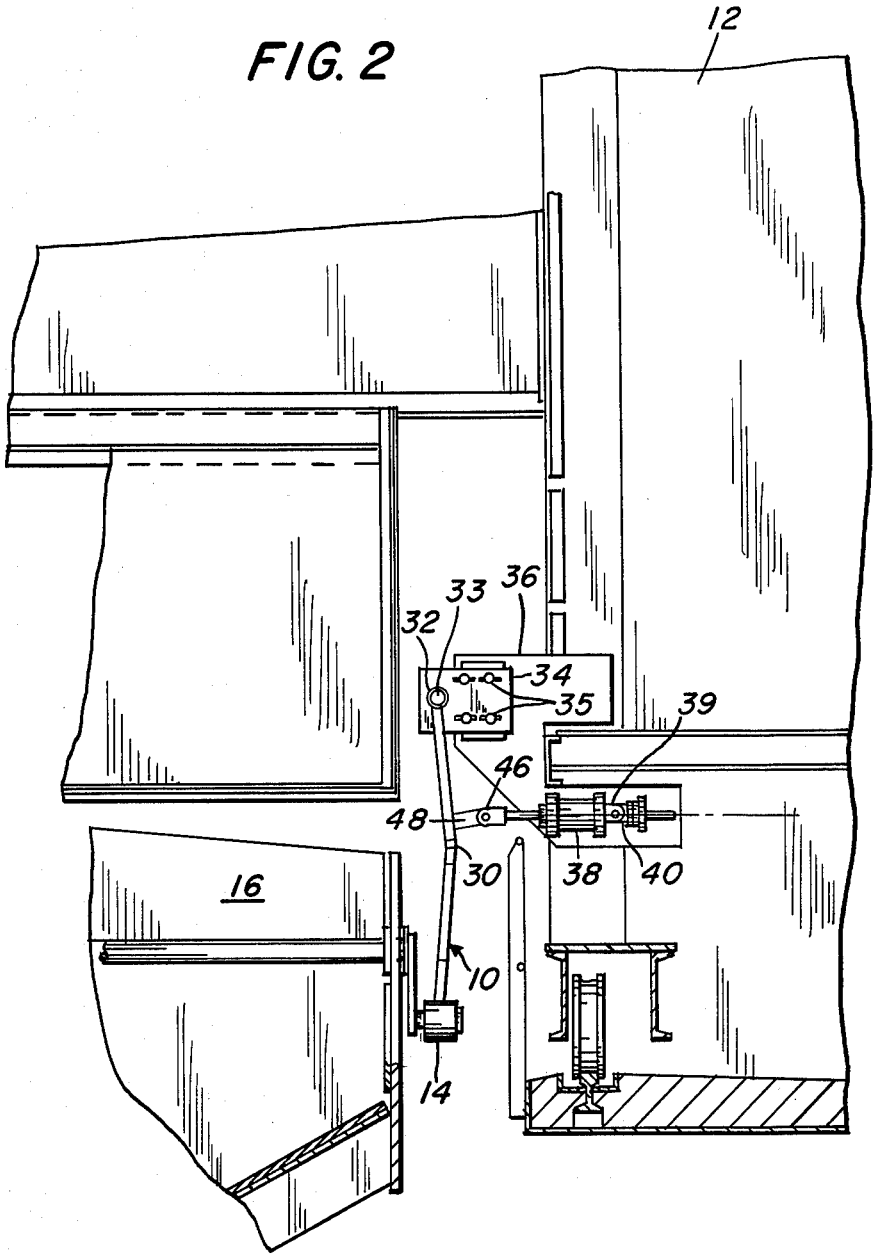
FIG. 2 is a vertical section along the line II—II of FIG. 1 illustrating the extended position of the tripper beam.

Tripper beam 10 is preferably fabricated in three sections with the end sections 18 and 20 at approximately an 18 degree angle from the center section 22. Three vertical support members 24, 26 and 28 are used to attach the tripper beam to the coke guide. They are bent at about their midpoint 30 approximately 5° away from the coke guide (FIG. 2). One end of each member is rigidly attached to the tripper beam 10. The other ends are pivotally mounted to the coke guide. Pipe sections 32 are mounted on the ends of the vertical supports opposite the tripper beam. Referring to FIG. 2, these pipe sections 32 pivot on shafts 33 which are mounted to the coke guide via adjustable plates 34, bolts 35, and mounting brackets 36. The mounting brackets 36 are preferably welded to the coke guide.

As best seen in FIG. 2, just above the midpoint of vertical support 28, a cylinder 38 having a rear clevis 39 is pivotally mounted to the coke guide by way of eye 40. The cylinder may be air of hydraulic, but air is preferred. Another cylinder 42 (FIG. 3) having a rear clevis 43 is similarly mounted to the coke guide above the midpoint of support 26 by way of eye 44. The rod of cylinder 38 has a rod eye 46 which is pivotally attached to vertical support 28 by means of clevis 48. Similarly, the rod of cylinder 42 has a rod eye 50 which is pivotally attached to vertical support 26 by means of clevis 52.

Figure 3:
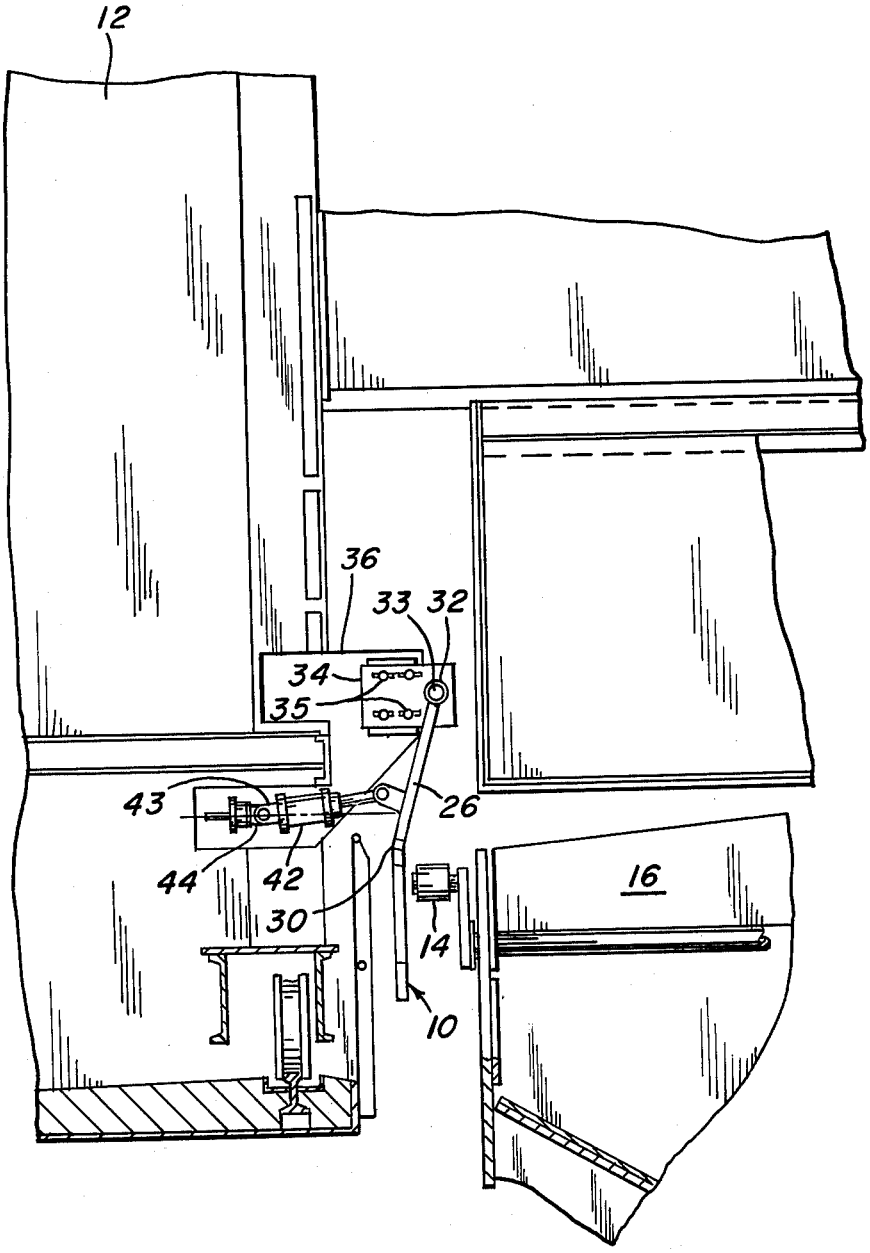
FIG. 3 is a vertical section along the line III—III of FIG. 1 illustrating the retracted position of the tripper beam.

In operation, the tripper beam 10 is extended by cylinders 38 and 42, as in FIG. 2, before the empty coke quench car is brought under the coke guide. When the car is under the guide, the cam followers 14 engage the tripper beam 10 to open the slats 16. After the quench car is filled and the coke therein is to be brought to the quench tower for quenching, the cylinders retract the tripper beam as in FIG. 3 and the quench car is able to pass the coke guide without engaging the cam followers with the beam. The 5° bend in the vertical supports 24, 26 and 28 provides positive cam follower-tripper beam contact when the beam is extended (FIG. 2) and maximum clearance between the cam followers 14 and the beam 10 when the beam is retracted (FIG. 3).

It is to be understood that variations may be made and still be within the scope of the invention defined in the following claims.

I claim:

1. In a pollution-controlled coke quench system which includes a slatted top quench car having a plurality of slats with cam followers and cranks attached to said slats and a tripper beam attached to a coke guide in front of a coke oven, said tripper beam for engaging said cam followers to actuate said slats, the improvement comprising:

means for pivoting said tripper beam away from said quench car to disengage said cam followers.

2. The improvement defined in claim 1 wherein said means for pivoting comprises:

air cylinders attached at one end to said tripper beam and at the other end to said coke guide, said tripper beam pivotally mounted to said coke guide.

* * * * *